US011614700B2

(12) United States Patent
Suzuki et al.

(10) Patent No.: US 11,614,700 B2
(45) Date of Patent: Mar. 28, 2023

(54) INTERMEDIATE TRANSFER MEMBER AND IMAGE FORMING APPARATUS

(71) Applicant: CANON KABUSHIKI KAISHA, Tokyo (JP)

(72) Inventors: Midai Suzuki, Tokyo (JP); Koji Sato, Ibaraki (JP); Akira Okano, Kanagawa (JP); Toshiyuki Yoshida, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/471,247

(22) Filed: Sep. 10, 2021

(65) Prior Publication Data

US 2022/0082964 A1 Mar. 17, 2022

(30) Foreign Application Priority Data

Sep. 16, 2020 (JP) ..... JP2020-155191

(51) Int. Cl.
*G03G 15/16* (2006.01)

(52) U.S. Cl.
CPC ..... *G03G 15/162* (2013.01); *G03G 15/161* (2013.01)

(58) Field of Classification Search
CPC ..... G03G 15/161; G03G 15/162
See application file for complete search history.

(56) References Cited

U.S. PATENT DOCUMENTS 5,468,584 A 11/1995 Go et al.
5,486,440 A 1/1996 Kashizaki et al.
5,488,461 A 1/1996 Go et al.
5,695,898 A 12/1997 Go et al.
6,432,324 B1 8/2002 Yoshida et al.
9,423,727 B2 8/2016 Yoshida et al.
10,372,067 B2 8/2019 Yoshida
2020/0019093 A1 1/2020 Tsuruga
2022/0082964 A1* 3/2022 Suzuki ..... G03G 15/161

FOREIGN PATENT DOCUMENTS

JP 6-254941 A 9/1994
JP 2002-24924 A 1/2002
JP 2010-25992 A 2/2010
JP 2010-250251 A 11/2010
JP 2015-87545 A 5/2015

OTHER PUBLICATIONS

B. D. Ripley, University of Cambridge, The Second Order-Analysis of Stationary Point Processes, J. Appl. Prob., vol. 13 (1976) 255-66.

* cited by examiner

*Primary Examiner* — Clayton E. LaBalle
*Assistant Examiner* — Michael A Harrison
(74) *Attorney, Agent, or Firm* — Venable LLP

(57) ABSTRACT

Provided is an intermediate transfer member containing a thermoplastic resin and carbon black. The carbon black has a structure volume of 50 or more and 250 or less, and a content of the carbon black is from 15.0 mass % to 30.0 mass % with respect to the intermediate transfer member. When a region ranging from an inner peripheral surface on a back side with respect to an outer peripheral surface on which a toner image is borne to 10 μm in a thickness direction is defined as an inner peripheral surface region, a value of an L-function indicating dispersibility of the carbon black with respect to the thermoplastic resin in the inner peripheral surface region is 150 nm or less.

6 Claims, 3 Drawing Sheets

INTERMEDIATE TRANSFER MEMBER AND IMAGE FORMING APPARATUS

BACKGROUND

Field

One embodiment of the present disclosure relates to an intermediate transfer member to be used in an image forming apparatus, such as a copying machine, a printer, and a facsimile, using an electrophotographic system or an electrostatic recording system. In addition, another embodiment of the present disclosure relates to an image forming apparatus.

Description of the Related Art

As an electrophotographic image forming apparatus, there is known an image forming apparatus using, as a method of transferring a toner image onto a transfer material, an intermediate transfer system for primarily transferring a toner image formed on a photosensitive member onto a belt-shaped intermediate transfer member and then secondarily transferring the toner image onto a transfer material.

In order to electrostatically transfer the toner image on the surface of the photosensitive member accurately onto the transfer material, it is preferred that a member to be used in the above-mentioned intermediate transfer member have a volume resistivity of a semi electro-conductive region and also have small variation in volume resistivity depending on the location of the member. Accordingly, it is required that the volume resistivity be substantially uniform in a plane associated with image formation. As the electric resistance value of the intermediate transfer member, those adjusted to within a range of a volume resistivity of from $1\times10^{8}$ Ω·cm to $1\times10^{13}$ Ω·cm and a surface resistivity of from $1\times10^{9}$Ω/□ to $1\times10^{15}$Ω/□ are used in many cases. As the target range of the electric resistance value, an optimum range is selected in accordance with a transfer portion configuration of the image forming apparatus in which an intermediate transfer belt is used and the charging characteristics of toner particles.

In Japanese Patent Application Laid-Open No. H06-254941, there is disclosed a belt obtained by extruding a polyetheretherketone resin (PEEK) containing an electro-conductive filler to a tubular film and then cutting the tubular film in a direction perpendicular to an axial direction. In addition, there is disclosed that each portion of the belt has a volume electric resistance value of from $10^{8}$ Ω·cm to $10^{17}$ Ω·cm.

In Japanese Patent Application Laid-Open No. 2015-87545, there is disclosed a belt obtained by molding a thermoplastic resin containing carbon black having a pH value of 8 or more, which serves as an electro-conductive filler, and potassium stearate or sodium stearate into a tubular film. In addition, there is disclosed that the content of the carbon black with respect to 100 parts by mass of the thermoplastic resin is from 18 parts by mass to 30 parts by mass.

However, in the intermediate transfer belt in which the carbon black is used to develop conductivity, the electric resistance may be decreased when the intermediate transfer belt is used for forming an electrophotographic image for a long period of time. In particular, in a primary transfer portion, when a gap is formed between an inner peripheral surface of the intermediate transfer member and a primary transfer roller, discharge occurs between the aggregated portion of the electro-conductive filler of the intermediate transfer member and the primary transfer roller, and the electric resistance of the intermediate transfer member may be locally decreased. Toner is not transferred to a portion in which the electric resistance is decreased, and a void image (blank dot) is generated. In addition, in a secondary transfer portion, when a gap is formed between an outer peripheral surface of the intermediate transfer member and paper, discharge occurs between the aggregated portion of the electro-conductive filler of the intermediate transfer member and the paper, and the charging polarity of the toner on the intermediate transfer member is reversed due to the discharge, with the result that the toner cannot be transferred to the paper to cause a blank dot. Those phenomena become conspicuous particularly when the dispersibility of the electro-conductive filler is poor or in a low humidity environment.

When extrusion is performed through use of an apparatus involving melt kneading under the condition that the molding temperature and the kneading degree are increased in a cylinder equipped with a screw, such as a kneading extruder, an extrusion molding machine, or an injection molding machine in order to improve the dispersion of the electro-conductive filler, the resin temperature is increased due to the heat generated by shearing. As a result, thermal deterioration (crosslinking caused by thermal decomposition or oxidation) of a resin material proceeds, and due to the generated thermal deterioration product or an aggregate of the thermal deterioration product, the electro-conductive filler, impurities, and the like, it becomes difficult to achieve excellent mechanical characteristics, optical characteristics, and electrical characteristics.

As described above, it has been difficult for the intermediate transfer member containing the resin material and the electro-conductive filler to stabilize the electrical characteristics over a long-term use.

SUMMARY

At least one aspect of the present disclosure is directed to providing an intermediate transfer member capable of maintaining stable electrical characteristics for a long period of time. In addition, another aspect of the present disclosure is directed to providing an electrophotographic image forming apparatus capable of stably forming a high-quality electrophotographic image.

According to one aspect of the present disclosure, there is provided an intermediate transfer member having an endless shape, the intermediate transfer member including a base layer, the base layer containing a thermoplastic resin and carbon black dispersed in the thermoplastic resin, the carbon black having a structure volume of 50 or more and 250 or less, a content of the carbon black being from 15.0 mass % to 30.0 mass % with respect to the base layer, wherein, when a region of the base layer ranging from an inner peripheral surface to 10 μm in a thickness direction toward an outer peripheral surface side in a cross-section of the base layer in the thickness direction is defined as an inner peripheral surface region, a value of an L-function indicating dispersibility of the carbon black with respect to the thermoplastic resin in the inner peripheral surface region is 150 nm or less.

According to another aspect of the present disclosure, there is provided an image forming apparatus including: a first image bearing member; an intermediate transfer member onto which an unfixed toner image formed on the first image bearing member is primarily transferred; and a secondary transfer unit configured to secondarily transfer the toner image primarily transferred onto the intermediate transfer member onto a second image bearing member, wherein the intermediate transfer member is the above-mentioned intermediate transfer member.

Further features of the present disclosure will become apparent from the following description of exemplary embodiments with reference to the attached drawings.

DESCRIPTION OF THE EMBODIMENTS

Now, an intermediate transfer member and a method of manufacturing an intermediate transfer member according to the present disclosure are described in more detail with reference to the drawings.

1. Image Forming Apparatus

Figure 2:
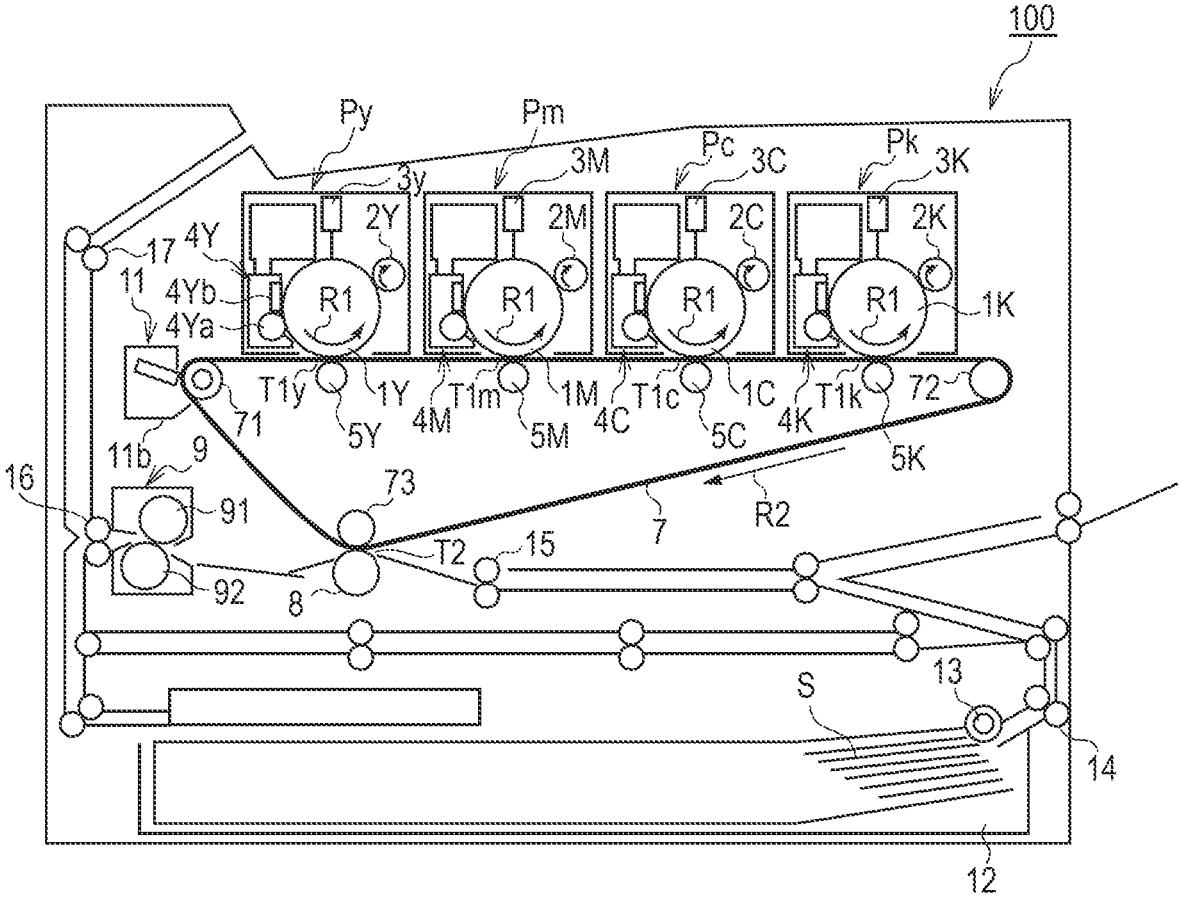
FIG. 2 is a schematic view of a cross-section of an image forming apparatus using the intermediate transfer member according to the present disclosure.

First, an image forming apparatus using an intermediate transfer member (intermediate transfer belt) according to one embodiment of the present disclosure is described. FIG. 2 is a schematic sectional view of an image forming apparatus 100 according to this embodiment. The image forming apparatus 100 according to this embodiment is a tandem-type color laser printer adopting an intermediate transfer system, which is capable of forming a full-color image through use of an electrophotographic system.

The image forming apparatus 100 includes first, second, third, and fourth image forming portions Py, Pm, Pc, and Pk as a plurality of image forming portions. The first, second, third, and fourth image forming portions Py, Pm, Pc, and Pk are arranged in the stated order along the moving direction of a flat portion (image transfer surface) of an intermediate transfer belt 7 described later. Elements having the same or corresponding functions or configurations in the first, second, third, and fourth image forming portions Py, Pm, Pc, and Pk are sometimes collectively described by omitting suffixes Y or "y", M or "m", C or "c", and K or "k" of reference symbols, which indicate that the elements are those for any colors. In this embodiment, the image forming portion P includes a photosensitive drum 1, a charging roller 2, an exposure device 3, a developing device 4, and a primary transfer roller 5 described later.

The image forming portion P includes the photosensitive drum 1 that is a drum-type (cylindrical) photosensitive member (electrophotographic photosensitive member) serving as an image bearing member. The photosensitive drum 1 is formed by laminating a charge generating layer, a charge transporting layer, and a surface protective layer in the stated order on a cylinder made of aluminum serving as a substrate. The photosensitive drum 1 is driven to rotate in a direction of the arrow R1 (counterclockwise direction) in the figure. The surface of the rotating photosensitive drum 1 is uniformly charged to a predetermined potential having a predetermined polarity (negative polarity in this embodiment) by the charging roller 2 that is a roller-shaped charging member serving as a charging unit. During a charging step, a predetermined charging bias (charging voltage) containing a DC component having a negative polarity is applied to the charging roller 2. The surface of the charged photosensitive drum 1 is scanned and exposed by the exposure device (laser scanner) 3 serving as an exposure unit in accordance with image information, and an electrostatic image (electrostatic latent image) is formed on the photosensitive drum 1.

The electrostatic image formed on the photosensitive drum 1 is developed (visualized) with toner serving as a developer supplied by the developing device 4 serving as a developing unit, and a toner image (developer image) is formed on the photosensitive drum 1. During a developing step, a predetermined developing bias (developing voltage) containing a DC component having a negative polarity is applied to a developing roller 4*a* serving as a developer carrying member provided in the developing device 4. In this embodiment, toner charged to the same polarity (negative polarity in this embodiment) as the charging polarity of the photosensitive drum 1 adheres to an exposure portion (image portion) on the photosensitive drum 1 having an absolute value of a potential decreased through exposure after being uniformly charged.

The intermediate transfer belt 7 formed of an endless belt serving as an intermediate transfer member is arranged so as to face the four photosensitive drums 1. The intermediate transfer belt 7 is tensioned under predetermined tension over a drive roller 71, a tension roller 72, and a secondary transfer opposing roller 73 serving as a plurality of tensioning rollers. When the drive roller 71 is driven to rotate, the intermediate transfer belt 7 is brought into contact with the photosensitive drum 1 to be rotated (moved around) in a direction of the arrow R2 (clockwise direction) in the figure. On an inner peripheral surface side of the intermediate transfer belt 7, a primary transfer roller 5 that is a roller-shaped primary transfer member serving as a primary transfer unit is arranged so as to correspond to each of the photosensitive drums 1. The primary transfer roller 5 is pressed against the photosensitive drum 1 through intermediation of the intermediate transfer belt 7 to form a primary transfer portion (primary transfer nip) T1 in which the photosensitive drum 1 and the intermediate transfer belt 7 are brought into contact with each other. An unfixed toner image formed on the photosensitive drum 1 as described above is primarily transferred onto the rotating intermediate transfer belt 7 through the action of the primary transfer roller 5 in the primary transfer portion T1. During a primary transfer step, a primary transfer bias (primary transfer voltage) that is a DC voltage having a polarity (positive polarity in this embodiment) opposite to the normal charging polarity of the toner (charging polarity during the developing step) is applied to the primary transfer roller 5. As the primary transfer roller 5, a primary transfer roller, which includes a metal rotary shaft and an elastic layer formed on an outer peripheral surface of the rotary shaft, and which is adjusted to a desired resistance value, is often used. However, the primary transfer roller 5 may be formed of a metal roller which is made of sulfur and sulfur composite free-cutting steel (SUM), stainless steel (SUS) or the like, and which has a straight shape in a thrust direction.

On an outer peripheral surface side of the intermediate transfer belt 7, a secondary transfer roller 8 that is a roller-shaped secondary transfer member serving as a secondary transfer unit is arranged at a position facing the secondary transfer opposing roller 73. The secondary transfer roller 8 is pressed against the secondary transfer opposing roller 73 through intermediation of the intermediate transfer belt 7 to form a secondary transfer portion (secondary transfer nip) T2 in which the intermediate transfer belt 7 and the secondary transfer roller 8 are brought into contact with each other. The toner image formed on the intermediate transfer belt 7 as described above is secondarily transferred onto a recording material (sheet, transfer material) S, such as paper (sheet of paper), conveyed while being sandwiched between the intermediate transfer belt 7 and the secondary transfer roller 8 through the action of the secondary transfer roller 8 in the secondary transfer portion T2. During a secondary transfer step, a secondary transfer bias (secondary transfer voltage) that is a DC voltage having a polarity opposite to the normal charging polarity of the toner is applied to the secondary transfer roller 8. In the secondary transfer, a transfer voltage of several kilovolts is usually applied in order to secure sufficient transfer efficiency. The recording material S is supplied to a conveyance path by a pickup roller 13 from a cassette 12 in which the recording material S is stored. The recording material S supplied to the conveyance path is conveyed to the secondary transfer portion T2 by a conveyance roller pair 14 and a registration roller pair 15 in synchronization with the toner image on the intermediate transfer belt 7.

The recording material S having the toner image transferred thereon is conveyed to a fixing device 9 serving as a fixing unit. The fixing device 9 heats and pressurizes the recording material S bearing the unfixed toner image to fix (melt, firmly fix) the toner image onto the recording material S. The recording material S having the toner image fixed thereon is delivered (discharged) to the outside of a main body of the image forming apparatus 100 by a conveyance roller pair 16, a delivery roller pair 17, and the like.

The toner (primary transfer residual toner) remaining on the surface of the photosensitive drum 1 without being transferred onto the intermediate transfer belt 7 during the primary transfer step is collected simultaneously with the development by the developing device 4 also serving as a photosensitive member cleaning unit. In addition, the toner (secondary transfer residual toner) remaining on the surface of the intermediate transfer belt 7 without being transferred onto the recording material S during the secondary transfer step is removed from the surface of the intermediate transfer belt 7 by a belt cleaning device 11 serving as an intermediate transfer member cleaning unit and collected. The belt cleaning device 11 is arranged on a downstream side of the secondary transfer portion T2 and on an upstream side of the most upstream primary transfer portion T1*y* in a rotating direction of the intermediate transfer belt 7 (at a position facing the drive roller 71 in this embodiment). The belt cleaning device 11 scrapes the secondary transfer residual toner from the surface of the rotating intermediate transfer belt 7 with a cleaning blade serving as a cleaning member arranged so as to be brought into abutment against the surface of the intermediate transfer belt 7 and accommodates the toner in a collection container 11*b*.

As described above, in the image forming operation, the electrical transfer process of the toner image from the photosensitive drum 1 to the intermediate transfer belt 7 and from the intermediate transfer belt 7 to the recording material S is repeated. In addition, when image formation on a large number of recording materials S is repeated, the electrical transfer process is further repeated.

2. Intermediate Transfer Member

Figure 1A:
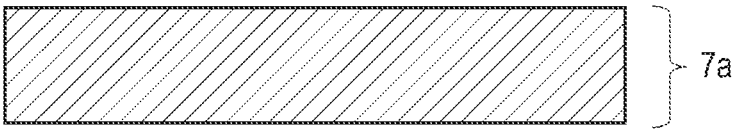
FIG. 1A is a schematic view of a cross-section of an intermediate transfer member according to the present disclosure.
Figure 1B:
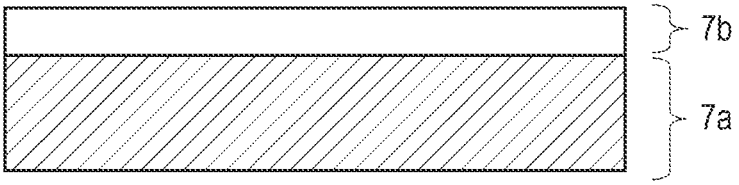
FIG. 1B is a schematic view of the cross-section of the intermediate transfer member according to the present disclosure.

The intermediate transfer belt 7 serving as an intermediate transfer member includes at least a base layer (base material), and may be a laminate formed of a plurality of layers further including a surface layer (front layer), and the like. FIG. 1A and FIG. 1B are each a schematic sectional view for illustrating an example of a layer configuration of the intermediate transfer belt 7. As illustrated in FIG. 1A, the intermediate transfer belt 7 may be formed of a single layer (herein, the single layer may also be sometimes referred to as "base layer") 7*a*. In addition, as illustrated in FIG. 1B, the intermediate transfer belt 7 may be formed of at least two layers of the base layer 7*a* and a surface layer 7*b* formed on the base layer 7*a*. For example, another layer such as an intermediate layer may be formed between the base layer 7*a* and the surface layer 7*b*. As described in detail below, the base layer 7*a* is a semi electro-conductive film containing an electro-conductive filler in a resin.

2-1. Configuration and Characteristics of Intermediate Transfer Member

<Resin Material>

As a resin material for the base layer of the intermediate transfer belt formed of a single layer or the intermediate transfer belt formed of at least two layers, there are given the following crystalline thermoplastic resins: a polyphenylene sulfide resin (PPS), a polyamide resin, a polyetherimide resin (PEI), a polyetheretherketone resin (PEEK), and the like. In particular, the polyetheretherketone resin (PEEK) is preferred because the intermediate transfer belt is required to have performance in which the intermediate transfer belt does not become loose even under a long-term tension load and does not wear on the surface by rubbing with a cleaning blade. In addition, two or more kinds of those resins may be selected and mixed for use as required.

<Electro-Conductive Filler>

At least one kind of electro-conductive filler, such as carbon black particles (hereinafter sometimes referred to as "carbon black" or "CB") or metal fine particles, is blended with the resin material for the purpose of, for example, imparting conductivity to the base layer. In the present disclosure, the carbon black is used from the viewpoint of mechanical and physical properties. The carbon black has various designations depending on the production method and raw materials. Specifically, there are given Ketjen black, furnace black, acetylene black, thermal black, gas black, and the like.

As the carbon black, various known carbon blacks may be used. Specific examples thereof include Ketjen black, furnace black, acetylene black, thermal black, and gas black. Of those, acetylene black and furnace black, which have few impurities, have a low frequency of foreign matter defects when molded into a film shape together with the above-mentioned thermoplastic resin, and easily obtain desired conductivity, are preferred. Specific examples of the acetylene black include: "Denka Black" series (manufactured by Denka Company Limited); "Mitsubishi conductive filler" series (manufactured by Mitsubishi Chemical Corporation); "VULCAN" series (manufactured by Cabot Corporation); "Printex" series (manufactured by Degussa AG); and "SRF" (manufactured by Asahi Carbon Co., Ltd.). Specific examples of the furnace black include: "TOKABLACK" series (manufactured by Tokai Carbon Co., Ltd.); "Asahi Carbon Black" series (manufactured by Asahi Carbon Co., Ltd.); and "NITERON" series (manufactured by Nippon Steel Carbon Co., Ltd.).

<Content of Carbon Black>

The content of the carbon black is selected in consideration of the ability to impart required conductivity to a belt member, the mechanical strength such as bending resistance and an elastic modulus of the belt member, and the thermal conductivity.

The content of the carbon black is set to 15.0 parts by mass or more and 30.0 parts by mass or less with respect to 100 parts by mass of the intermediate transfer member. That is, when the intermediate transfer member is formed of only a single base layer containing a thermoplastic resin and carbon black dispersed in the thermoplastic resin, the content of the carbon black is from 15.0 mass % to 30.0 mass % with respect to the base layer. When the content of the carbon black is set to within the above-mentioned range, conductivity suitable for the intermediate transfer belt and sufficient mechanical strength can be secured. The preferred content of the carbon black is from 20.0 mass % to 28.0 mass % with respect to the intermediate transfer member.

2-2. Method of Manufacturing Intermediate Transfer Member

The base layer of the intermediate transfer member according to the present disclosure may be produced, for example, through the following steps (1) and (2):

Step (1): A step of mixing a thermoplastic resin and carbon black in a temperature environment equal to or higher than the glass transition point of the thermoplastic resin to obtain a resin mixture; and Step (2): A step of melting the resin mixture at a temperature equal to or higher than the melting temperature of the thermoplastic resin and extruding the resultant into a tube shape.

Now, the step (1) and the step (2) are described.

<Step (1): Mixing Step>

In the mixing step, a thermoplastic resin and carbon black are mixed at a temperature equal to or higher than the glass transition point of the thermoplastic resin to obtain a resin mixture. As a mixer that may be used in this step, for example, a twin-screw kneader having two screws in a barrel or a cylinder may be used.

The mixture supplied from a supply hole of a supply portion undergoes heat generation by shearing due to friction between the barrel or the cylinder, the screw, and the raw material while advancing toward a die by the rotation of the screw, and is melt-mixed. In this case, when the temperature in the barrel or the cylinder becomes too high, the resin material is thermally decomposed or thermally deteriorated. Accordingly, it is preferred to control the temperature of the raw material so that the temperature of the raw material does not become too high by cooling the barrel or the cylinder from the outside, adjusting the temperature, adjusting the rotation speed of the screw, and the like. In addition, when the temperature of the barrel or the cylinder becomes too low, the resin material does not form a stable molten state, and hence the dispersed state of the electro-conductive filler becomes non-uniform. As a result, it may be difficult to obtain a mixture excellent in mechanical, electrical, and optical characteristics. A strand die is usually installed in a distal end portion of the twin-screw kneader, and the mixture is extruded into a rod shape, air-cooled, and then cut to prepare a pellet-shaped mixture.

Before the mixing step, there may be provided a premixing step of mixing the thermoplastic resin and the carbon black at a temperature lower than the glass transition point of the thermoplastic resin through use of a fluidizing mixer. As the fluidizing mixer, various known mixers each having a mechanism of mixing through use of the flow motion of a solid may be used. Specifically, a mixer, such as a Henschel mixer, a ribbon mixer, or a planetary mixer, may be used. Of those, it is preferred to use a Henschel mixer from the viewpoint of mixing efficiency. In addition, it is required to appropriately select the rotation speed, treatment time, treatment amount, and the like of the fluidizing mixer depending on the material.

<Step (2): Molding Step>

In the molding step, the resin mixture obtained in the mixing step is molded into a cylindrical tube having an endless belt shape. In molding, a method, such as an extrusion molding method or an inflation molding method, may be selected depending on the resin to be used, but it is preferred to use a cylindrical extrusion molding method from the viewpoint of productivity. As an extruder in the extrusion molding method, a single-screw extruder having one screw in a barrel or a cylinder or a multi-screw extruder in which two or more screws are combined may be used. The pellet-shaped mixture supplied from the supply hole of the supply portion receives thermal energy from the barrel or the cylinder and mechanical energy from the screw while advancing toward the die by the rotation of the screw, and is substantially completely melted. Then, the resultant is quantitatively supplied to the distal end portion of the extruder. A cylindrical die is installed in the distal end portion of the extruder, and the mixture is molded into a cylindrical tube shape by extruding the mixture downward from the cylindrical die and taking the mixture from below.

Although not limited to the following, the thickness of the base layer of the intermediate transfer member formed of a single layer or the intermediate transfer member formed of at least two or more layers is usually from about 10 μm to about 500 typically from about 50 μm to about 200

2-3. Reduction in Resistance of Intermediate Transfer Member

When an appropriate amount of carbon black is added to a resin, followed by kneading, and the kneaded product is molded into a sheet to develop conductivity as a sheet, there are a plurality of electro-conductive paths formed of a large number of CB particles connected to each other from a front surface to a back surface of the sheet in the resin. In this case, the electric resistance value of each of the electro-conductive paths is the sum of the electric resistance value of the electro-conductive portion made of the CB and the electric resistance value of the contact portion when the CB particles are connected to each other.

When the sheet-shaped molded product is, for example, an intermediate transfer member to be mounted on a copying machine, discharge may occur between the secondary transfer roller and the intermediate transfer member during printing. In such a case, there is a problem in that the load caused by energization of the intermediate transfer member is concentrated, and the electric resistance value of the intermediate transfer member is decreased over time, with the result that the image quality is deteriorated.

This is because the electrical resistance value of each of the electro-conductive paths formed of the large number of the CB particles connected to each other is decreased. More specifically, it can be assumed that the electric resistance value of the contact portion when the CB particles are connected to each other is decreased rather than the decrease in electric resistance value of the CB particles themselves (electro-conductive portion) in the electro-conductive path.

That is, it is conceived that the electric field is concentrated on the contact portion between the CB particles due to the application of a voltage during printing, and the heat generation caused by the concentration of the electric field carbonizes the resin on the periphery of the contact portion and causes dielectric breakdown. Accordingly, in order to prevent the decrease in electric resistance value of the electro-conductive path, it is important to suppress the heat generation caused by the concentration of the electric field so that the resin on the periphery of the contact portion is not carbonized.

A calorific value Q of the contact portion when the CB particles in the electro-conductive path are connected to each other is represented by the expression (1), and in order to reduce the calorific value, it is required to decrease a voltage (V) or increase a resistance value (R).

$$Q=V\times V\times t/R \quad (1)$$

Q: Calorific value
V: Voltage flowing in path
R: Resistance value of contact portion
t: Time The voltage (V) is determined by printing conditions, and hence the voltage cannot be decreased.

Meanwhile, the resistance value R of the contact portion between the CB particles is represented by the expression (2), and it is required to reduce a structure volume "a" of the CB in order to increase the resistance value R of the contact portion.

$$R=\rho/(2\times a\times n) \quad (2)$$

R: Resistance value of contact portion
ρ: Intrinsic resistance value of carbon black
a: Structure volume of carbon black
n: Number of contact points 2-4. Particle Diameter of Primary Particles of Carbon Black As the electro-conductive filler to be added, it is preferred to use an electro-conductive filler having an average particle diameter of primary particles of 10 nm or more and 30 nm or less. When an electro-conductive filler having an average particle diameter of primary particles of less than 10 nm is used, the electro-conductive filler is liable to be reaggregated, and the heat resistance is decreased, with the result that it becomes difficult to use such an electro-conductive filler in the intermediate transfer member. Meanwhile, when an electro-conductive filler having an average particle diameter of primary particles of more than 30 nm is used, the dispersibility is liable to be decreased when aggregated clots are generated, and the resistance of the intermediate transfer member is liable to be decreased due to discharge. Accordingly, through use of particles having an average particle diameter of the primary particles falling within the above-mentioned ranges, satisfactory resistance maintenance without defects is obtained.

2-5. Method of Evaluating Particle Diameter of Primary Particles of Carbon Black Contained in Base Layer Observation of carbon black contained in the base layer is performed with a transmission electron microscope (TEM), but preparation of a thinned sample before observation is performed by a known method. For example, a sample may be thinned with an ion beam, a diamond knife, or the like. In the following Examples, a cutting piece sample for observation having a thickness of about 40 nm in which a cross-section of the base layer in a total thickness direction appeared was collected through use of "ULTRACUT-S" (product name, manufactured by Leica Microsystems). Then, a TEM image was acquired through use of a transmission electron microscope (TEM) (product name: H-7100FA, manufactured by Hitachi, Ltd.) under measurement conditions of a TE mode and an acceleration voltage of 100 kV. For the analysis of the acquired TEM image, for example, known image analysis software, such as "WinROOF" (product name, manufactured by Mitani Corporation) and "ImagePro" (product name, manufactured by Nippon Roper K.K.) may be used. In the following Examples, "WinROOF" was used. Then, the area-equivalent diameters of 50 primary particles of the carbon black were measured, and the average value thereof was defined as the average particle diameter of the primary particles.

2-6. Method of Evaluating DBP Oil Absorption of Carbon Black Contained in Base Layer The dibutyl phthalate (DBP) oil absorption of carbon black contained in an intermediate transfer member (electro-conductive belt) to be measured may be determined as described below.

The carbon black contained in the intermediate transfer belt may be observed with a transmission electron microscope (TEM). Preparation of a thinned sample before observation may be performed in the same manner as described above. Then, in the following Examples, a TEM image of the prepared thinned sample was acquired through use of the above-mentioned TEM under measurement conditions of a TE mode, an acceleration voltage of 100 kV, and such a magnification that one side of the image was 3 μm or less. The minimum structural unit of the carbon black is a primary aggregate in which primary particles were connected to each other, and hence the distribution of the maximum Feret diameter in the carbon black primary aggregate is analyzed from the acquired TEM image. The maximum Feret diameter corresponds to the length of the maximum long side of a rectangle circumscribing the carbon black primary aggregate.

The above-mentioned known image analysis software may also be used for analysis of the maximum Feret diameter from the acquired TEM image, and in the present disclosure, "WinROOF" was used.

By binarizing and extracting the carbon black primary aggregate portion from the acquired TEM image through use of image analysis software, the maximum Feret diameter distribution of the carbon black primary aggregate scattered in the image can be analyzed. In this case, it is known that there is a correlation between the peak top position of the maximum Feret diameter and the DBP oil absorption that is an indicator of the size of the carbon black primary aggregate. By checking the number of peak tops and the peak top positions of the maximum Feret diameter, the kinds of carbon blacks having different DBP oil absorptions and the DBP oil absorption of each of the carbon blacks can be determined.

2-7. Structure Volume

The CB has a structure in which a plurality of spherical primary particles are randomly fused to each other.

This structure is called a "structure" as the minimum structure of the CB, and is one of the characteristics representing the connected state of CB particles. The DBP oil absorption (specified under JIS6217-4) is used as an indicator for inferring the magnitude of the structure of the CB, but is not perfect for considering the volume of the structure. Further, the volume of the structure can be expressed by the product obtained by multiplying the volume of the primary particle by the number of the connected particles, but it is not easy to determine the number of the connected particles.

Accordingly, the inventor has clarified that a volume index value "a" corresponding to the structure volume of the CB is expressed by the expression (3).

$$\alpha=(d^2)\times(D\times c1+c2) \quad (3)$$

d: Particle diameter of primary particles (nm)
D: DBP oil absorption (mL/100 g)
c1, c2: Constant The following is conceived. When the volume index value "a" becomes smaller, the structure volume of the CB also becomes smaller. Accordingly, the resistance value R of the contact portion between the CB particles is increased, and the calorific value Q of the contact portion is suppressed. As a result, a decrease in electric resistance value over time, which is caused by the concentration of the load caused by energization of the intermediate transfer member, can be suppressed.

The structure volume of the carbon black is evaluated by a method described later, and is 50 or more and 250 or less. When the structure volume is more than 250, a decrease in resistance of the intermediate transfer member is liable to occur due to the concentration of the electric field in the contact portion between the CB particles. In addition, when the structure volume is less than 50, the cohesive force between the CB particles becomes too large, and hence it becomes difficult to satisfactorily maintain the dispersed state of the electro-conductive filler in the intermediate transfer belt. In the present disclosure, the structure volume of the carbon black is preferably 150 or more and 160 or less.

Between the structure volume (structural volume) "a" and the volume index value "α", there is a degree of freedom regarding the constants c1 and c2 as represented by the expression (3), but the structure volume (structural volume) "a" according to the present disclosure is defined to be calculated by the expression (4).

$$a=(1/3)\times\pi\times(d^2/2)\times(0.0046\times D+0.1435) \quad (4)$$

2-8. Dispersibility

The dispersibility of the carbon black having the structure volume (structural volume) "a" in the resin is evaluated by an L-function described later.

When the intermediate transfer member according to the present disclosure is used in the primary transfer portion, the intermediate transfer member having a value of the L-function of 150 nm or less in the following inner peripheral surface region is used. This is because, when the value of the L-function is more than 150 nm, a decrease in resistance of the intermediate transfer member is liable to occur due to the discharge in the primary transfer portion.

When the intermediate transfer member according to the present disclosure is used in the secondary transfer portion, the intermediate transfer member having an average value of the L-function of 150 nm or less in the following central region, inner peripheral surface region, and outer peripheral surface region is used. This is because, when the above-mentioned average value of the L-function is more than 150 nm, a decrease in resistance of the intermediate transfer member is liable to occur due to the discharge in the secondary transfer portion.

2-9. Method of Evaluating Dispersibility

Figure 3:
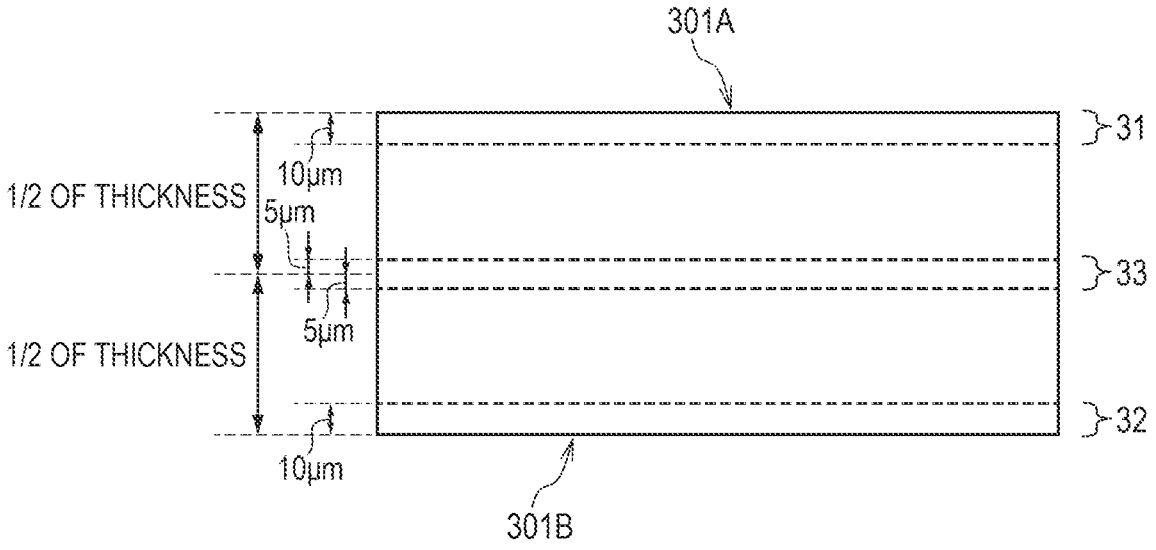
FIG. 3 is a schematic view for illustrating a region of the intermediate transfer member in which measurement is performed in order to evaluate dispersibility.

In a base layer 301 of the intermediate transfer member (electro-conductive belt) to be measured, the dispersed state of the electro-conductive filler in each of the following regions (1) to (3) illustrated in FIG. 3 was measured by the following procedure:

(1) a region ranging from a surface (outer peripheral surface) 301A on a side on which a toner image is borne to 10 μm in a thickness direction (region 31 illustrated in FIG. 3, referred to as "outer peripheral surface region");

(2) a region ranging from an inner peripheral surface 301B on a back side with respect to the outer peripheral surface to 10 μm in the thickness direction toward the outer peripheral surface 301A (region 32 illustrated in FIG. 3, referred to as "inner peripheral surface region"); and (3) a region ranging from a central portion in the thickness direction to 5 μm in a direction of the outer peripheral surface and ranging from the central portion in the thickness direction to 5 μm in a direction of the inner peripheral surface (region 33 illustrated in FIG. 3, referred to as "central region").

First, the electro-conductive belt is cut out into a strip shape of about 10 mm×10 mm in the surface direction with a cutter knife or the like, and then embedded with an epoxy resin. After curing, sectional samples in each of which the cross-section of the entire thickness portion appears are prepared with abrasive paper. SEM images at a magnification of 20,000 are acquired on the front surface side (outer peripheral surface region), back surface side (inner peripheral surface region), and central portion (central region) of each of the obtained sectional samples through use of a scanning electron microscope (product name: XL-30 SFEG, manufactured by Philips Inc.). When the contrast is unclear, black-and-white emphasis processing or smoothing processing is appropriately performed. As the image processing software, software such as "Photoshop" (trademark) and "ImageJ" may be used.

Next, the coordinates of the position of the center of gravity of the electro-conductive filler in a visual field width are obtained, and a K-function is calculated by the following expression.

$$K(d)=\frac{1}{\lambda}\left(\frac{1}{n}\sum_{i\neq j}\frac{1}{w_j}I_d(i,j)\right)$$

Herein, "i" represents an indicator for indicating particles in the image, "k" represents the number density of particles in the image (the number of the particles per unit area), and "n" represents the number of the particles in the image. "$w_i$" represents a ratio (area B/area A) between "the area A of a circle "i" having a radius "d" centered around coordinates of the center of gravity of the particle "i"" and "the area B of a portion included in the image in the circle "i" having a radius "d" centered around the coordinates of the center of gravity of the particle "i"". The "$w_i$" is used for correcting the underestimation caused by the absence of the particles outside the image when the particles "i" are present in the vicinity of an image boundary. $I_d$ (i, j) represents a function that takes a value of 1 when the coordinates of the center of gravity of the particle "j" are within the circle having the radius "d" centered around the coordinates of the center of gravity of the particle "i" and takes a value of 0 otherwise (see Ripley B. D., J. Appl. Prob, 13, 255 (1976)).

Further, the L-function is calculated by the following expression for the obtained K-function.

$$L(d)=\sqrt{\frac{K(d)}{\pi}}-d$$

Then, as described below, the simple sum of L(d) calculated by changing "d" every 10 nm from 0 nm to 500 nm is defined as the L-function value in this case.

$$L(0) = (K(0)/\pi)(1/2);$$

$$L(10) = (K(10)/\pi)(1/2) - 10;$$

$$\vdots$$

$$L(490) = (K(490)/\pi)(1/2) - 490;$$

$$L(500) = (K(500)/\pi)(1/2) - 500;$$

$$L - \text{function value} = L(0) + L(10) + \ldots + L(490) + L(500)$$

The range of from 0 nm to 500 nm of "d" to be used for calculating the L-function indicates the radius of the circle centered around each particle in the image. When the image range of the SEM to be used for evaluation is too small with respect to d=500 nm, which is the maximum radius of the measurement circle, an error becomes large. Accordingly, the SEM magnification at the time of measurement is limited to 20,000 times. Regarding the size of the actual observation region included in the image photographed under these conditions, although depending on a measurement unit and the size of a region in which "information on portions other than the image portion included in the image" is displayed, a short side is from about 3 μm to about 4 μm, and a long side is from about 5 μm to about 6 μm. The "information on portions other than the image portion included in the image" means information such as magnification and scale, and the portion in which such information is displayed is not included in a measurement target.

Further, in each of the following Examples, the L-function value is obtained in each of the following regions (1) to (3):

(1) a region centered around a position 5 μm away from the toner image bearing surface (outer peripheral surface) in the thickness direction;

(2) a region centered around a position 5 μm away from the back side (inner peripheral surface) with respect to the outer peripheral surface of (1) in the thickness direction; and (3) a region centered around the central portion in the thickness direction.

The L-function value and an arithmetic mean value thereof (arithmetic average value) in each of the above-mentioned regions (1) to (3) are shown in Table 1.

2-10. pH of Carbon Black

In this embodiment, carbon black having a pH value of 8 or more is used as the carbon black. When the pH value is 8 or more, the liquid cross-linking force of surface functional groups of the carbon black is reduced, and the aggregation of the carbon black particles is more effectively suppressed.

The pH value of the carbon black is more preferably 9 or more, still more preferably 10 or more, and the upper limit value is not particularly limited.

The pH value of the carbon black is measured by preparing a mixed solution of carbon black and pure water and measuring the pH value of the mixed solution with a glass electrode pH meter.

2-11. Method of Evaluating Amount of Carbon Black contained in Base Layer

The amount of the carbon black contained in the intermediate transfer member may be evaluated by thermogravimetric analysis (TGA). In this Example, evaluation was made through use of a thermogravimetric analyzer (TGA851e/SDTA) manufactured by METTLER TOLEDO. A thermoplastic resin component in the intermediate transfer member (ITB) is decomposed and removed by heating at 600° C. for 1 hour under a nitrogen gas atmosphere, and thus the mass of only the contained carbon can be evaluated.

According to one embodiment of the present disclosure, the intermediate transfer member capable of stably maintaining excellent electrical characteristics for a long period of time can be obtained. In addition, according to another embodiment of the present disclosure, the image forming apparatus capable of stably forming a high-quality electrophotographic image, which uses the intermediate transfer member, can be provided.

EXAMPLES

The following intermediate transfer member and electrophotographic image forming apparatus according to the present disclosure are specifically described by way of Examples. The present disclosure is not limited to configurations embodied in the Examples. In addition, the number of parts in Examples and Comparative Examples is based on mass unless otherwise stated.

<Preparation of Carbon Black>

Carbon black shown in the following Table 1 was prepared as carbon black to be used for manufacturing intermediate transfer belts according to Examples and Comparative Examples. Physical properties (DBP absorption, primary particle diameter, pH value, and structure volume value) of each carbon black are shown in Table 1.

TABLE 1

| Carbon black | | | | | | |
|---|---|---|---|---|---|---|
| No. | Brand name/product name | Name of manufacturing company | DBP oil absorption (mL/100 g) | Primary particle diameter (nm) | pH value | Structure volume value |
| 1 | #44 | Mitsubishi Chemical Corporation | 77 | 24 | 8 | 150 |
| 2 | #52 | Mitsubishi Chemical Corporation | 60 | 27 | 8 | 160 |
| 3 | #850 | Mitsubishi Chemical Corporation | 74 | 17 | 8 | 73 |
| 4 | #33 | Mitsubishi Chemical Corporation | 74 | 30 | 8 | 228 |
| 5 | TOKABLACK #7550SB | Tokai Carbon Co., Ltd. | 53 | 21 | 7.5 | 89 |
| 6 | #MA600 | Mitsubishi Chemical Corporation | 115 | 20 | 7 | 141 |
| 7 | Li#435SB | Denka Company Limited | 220 | 23 | 9 | 320 |

TABLE 1-continued

| Carbon black | | | | | | |
|---|---|---|---|---|---|---|
| No. | Brand name/product name | Name of manufacturing company | DBP oil absorption (mL/100 g) | Primary particle diameter (nm) | pH value | Structure volume value |
| 8 | #2300 | Mitsubishi Chemical Corporation | 48 | 15 | 8 | 43 |

Example 1

Materials shown in the following Table 2 were melted and mixed using a twin-screw kneading extruder (Product name: PCM43, manufactured by Ikegai Corporation) under the following conditions to produce a resin composition.
Extrusion rate: 6 kg/h
Screw rotation speed: 225 rpm
Barrel control temperature: 360° C.

TABLE 2

| Material | Blending amount |
|---|---|
| Carbon Black No. 1 | 28 Parts by mass |
| PEEK (product name: 450G; manufactured by Victrex plc)<br>Glass transition temperature: 145° C.<br>Melting point: 335° C. | 72 Parts by mass |

The resin composition was then melt-extruded using a single-screw extrusion molding machine (Plastics Engineering Laboratory Co., Ltd.) equipped with a spiral cylindrical die (inner diameter: 285 mm, slit width: 1.1 mm) at the tip under the following conditions to produce a tubular tube-shaped electrophotographic belt (Φ280 mm and a thickness of 60 μm) according to the present Example.
Extrusion rate: 6 kg/h
Dice temperature: 380° C.

Example 2

An electrophotographic belt for an intermediate transfer belt was produced in the same manner as in Example 1 except that the kind of the carbon black and the blending amount thereof, and the blending amount of the thermoplastic resin were set as shown in Table 3.

Comparative Example 1 to Comparative Example 8

Electrophotographic belts for intermediate transfer belts were each produced in the same manner as in Example 1 except that the kind of the carbon black and the blending amount thereof, and the blending amount of the thermoplastic resin were set as shown in Table 3.

TABLE 3

| | Carbon Black | | Thermoplastic resin | |
|---|---|---|---|---|
| | No. | Blending amount | Type of material | Blending amount |
| Example 1 | 1 | 28.0 | PEEK | 72.0 |
| Example 2 | 2 | 25.0 | PEEK | 75.0 |
| Comparative Example 1 | 1 | 13.0 | PEEK | 87.0 |
| Comparative Example 2 | 1 | 35.0 | PEEK | 65.0 |
| Comparative Example 3 | 3 | 38.0 | PEEK | 62.0 |
| Comparative Example 4 | 4 | 26.0 | PEEK | 74.0 |
| Comparative Example 5 | 5 | 28.0 | PEEK | 72.0 |
| Comparative Example 6 | 6 | 26.0 | PEEK | 74.0 |
| Comparative Example 7 | 7 | 28.0 | PEEK | 72.0 |
| Comparative Example 8 | 8 | 15.0 | PEEK | 85.0 |

The electrophotographic belts according to Examples 1 and 2 and Comparative Examples 1 to 8 were subjected to the following evaluations 1 to 3. The results are shown in Table 4. The electrophotographic belts according to Comparative Examples 2 and 3 were not subjected to the evaluations 2 and 3 because the obtained electrophotographic belts were fragile due to the large blending amount of the carbon black.

[Evaluation 1]

Regarding the electrophotographic belts according to Examples 1 and 2 and Comparative Examples 1 to 8, L-functions of an outer region, an inner region, and a central region were obtained through use of the above-mentioned method.

[Evaluation 2]

The surface resistivity of the inner peripheral surface of each of the electrophotographic belts according to Examples 1 and 2 and Comparative Examples 1 to 8 was measured through use of a resistivity meter (product name: Hiresta UP MCP-HT450, manufactured by Mitsubishi Chemical Analytech Co., Ltd.) based on the Japanese Industrial Standards (JIS) K6911:2006 Testing methods for thermosetting plastics. The measurement was performed by bringing a URSS probe into abutment against the inner peripheral surface in an environment of a temperature of 23° C. and a relative humidity of 50% at an applied voltage of 10 V for a measurement time of 10 seconds. The average value of measurement values at any four points was defined as the surface resistivity of the inner peripheral surface of each of the electrophotographic belts, and was evaluated based on the following criteria.

Rank A: The surface resistivity is within a range of from $1\times10^{9}\Omega/\square$ to $1\times10^{15}\Omega/\square$ Rank B: The surface resistivity is out of the range of from $1\times10^{9}\Omega/\square$ to $1\times10^{15}\Omega/\square$.

[Evaluation 3]

Each of the electrophotographic belts according to Examples 1 and 2 and Comparative Examples 1 to 8 was mounted as an intermediate transfer belt of the electrophotographic image forming apparatus (product name: image RUNNER-ADVANCE-05540, manufactured by Canon Inc.) illustrated in FIG. 2. Through use of the electrophotographic image forming apparatus, a solid white image was output on 600,000 sheets through use of A3-size plain paper (product name: CS068, manufactured by Canon Inc.) in a low humidity environment (temperature of 23° C./relative humidity of 5%). In this process, every time the solid white image was output on 10,000 sheets, a black entire halftone image was continuously output on five sheets. The obtained five sheets of the entire halftone image output in the sixtieth set, that is, after the formation of the solid white image on 600,000 sheets were visually observed and evaluated based on the following criteria.

Rank A: No blank dots were recognized in any of the five sheets of the halftone image. (The electrical resistance of the intermediate transfer member is not easily decreased. That is, the resistance maintenance thereof is high).

Rank B: Blank dots were recognized in one or two of the five sheets of the halftone image.

Rank C: Blank dots were recognized in three of the five sheets of the halftone image.

TABLE 4

| | Evaluation 1 L-function | | | | Evaluation 2 | Evaluation 3 |
|---|---|---|---|---|---|---|
| | Outer region | Inner region | Central region | Average value | Rank | Rank |
| Example 1 | 130.0 | 134.8 | 126.3 | 130.0 | A | A |
| Example 2 | 141.6 | 147.9 | 144.2 | 145.0 | A | A |
| Comparative Example 1 | 230.0 | 265.3 | 224.2 | 240.0 | A | C |
| Comparative Example 2 | 181.2 | 173.2 | 186.2 | 180.0 | — | — |
| Comparative Example 3 | 126.3 | 132.2 | 130.7 | 130.0 | — | — |
| Comparative Example 4 | 166.2 | 177.8 | 176.1 | 173.0 | A | B |
| Comparative Example 5 | 180.2 | 161.0 | 168.8 | 170.0 | A | C |
| Comparative Example 6 | 200.2 | 195.1 | 190.3 | 195.0 | A | C |
| Comparative Example 7 | 137.0 | 142.4 | 140.0 | 140.0 | A | C |
| Comparative Example 8 | 196.3 | 202.2 | 201.7 | 200.0 | B | C |

In the electrophotographic belt according to Comparative Example 8 in which the surface resistivity was not able to be adjusted to within a range of from $1\times10^{9}$ Ω/□ to $1\times10^{15}$Ω/□, it is conceived that the structure volume of the carbon black used in Comparative Example 8 was small, and hence the cohesive force between the carbon black particles was large, with the result that a satisfactory dispersed state of the carbon black was not able to be achieved in the resin.

In addition, in each of Comparative Examples 1 and 8, it is conceived that the content of the carbon black used in each of Comparative Examples 1 and 8 was too small to achieve a satisfactory dispersed state of the carbon black in the resin, with the result that the evaluation regarding blank dots was C.

In each of Comparative Examples 5 and 6, it is conceived that the low pH value of the carbon black promoted the aggregation of the carbon black particles, and a satisfactory dispersed state of the carbon black was not able to be achieved in the resin, with the result that the evaluation regarding blank dots was C. In this case, it is conceived that a blank dot image was generated due to the discharge that occurred in a gap between the inner peripheral surface side of the intermediate transfer member and the primary transfer roller in the primary transfer portion or a gap between the outer peripheral surface of the intermediate transfer member and the paper in the secondary transfer portion.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-155191, filed Sep. 16, 2020, which is hereby incorporated by reference herein in its entirety.

What is claimed is:

1. An intermediate transfer member having an endless shape, the intermediate transfer member comprising:

a base layer containing a thermoplastic resin having carbon black dispersed therein;

the carbon black having a structure volume of 50 to 250, defined by structure volume=$(1/3)\times\pi\times(d^2/2)\times(0.0046\times D+0.1435)$ where d (nm) represents particle diameter of primary particles of the carbon black and D (mL/100 g) represents DBP oil absorption, wherein a content of the carbon black is 15.0 to 30.0 mass % with respect to the base layer, and a value of an L-function indicating dispersibility of the carbon black with respect to the thermoplastic resin in an inner peripheral surface region is 150 nm or less when the inner peripheral surface region is a region of the base layer ranging from an inner peripheral surface to 10 μm in a thickness direction toward an outer peripheral surface side in a cross-section of the base layer in the thickness direction.

2. The intermediate transfer member according to claim 1, wherein the carbon black has a pH value of 8 or more.

3. The intermediate transfer member according to claim 1, wherein the thermoplastic resin comprises at least one member selected from the group consisting of a polyetheretherketone resin, a polyphenylene sulfide resin, a polyamide resin and a polyetherimide resin.

4. The intermediate transfer member according to claim 1, wherein the carbon black has a structure volume of from 150 to 160.

5. The intermediate transfer member according to claim 1, wherein the carbon black has an average primary particle diameter of 10 to 30 nm.

6. An electrophotographic image forming apparatus, comprising:

a first image bearing member configured to bear an unfixed toner image;

an intermediate transfer member onto which the unfixed toner image formed on the first image bearing member is configured to be primarily transferred; and a secondary transfer unit configured to secondarily transfer the toner image from the intermediate transfer member onto a second image bearing member, the intermediate transfer member having an endless shape and comprising a base layer containing a thermoplastic resin having carbon black dispersed therein;

the carbon black having a structure volume of 50 to 250, defined by structure volume=$(1/3)\times\pi\times(d^2/2)\times(0.0046\times D+0.1435)$ where d (nm) represents particle diameter of primary particles of the carbon black and D (mL/100 g) represents DBP oil absorption, wherein a content of the carbon black is 15.0 to 30.0 mass % with respect to the base layer, and a value of an L-function indicating dispersibility of the carbon black with respect to the thermoplastic resin in an inner peripheral surface region is 150 nm or less when the inner peripheral surface region is a region of the base layer ranging from an inner peripheral surface to 10 μm in a thickness direction toward an outer peripheral surface side in a cross-section of the base layer in the thickness direction.

* * * * *